United States Patent [19]

Lindsay

[11] Patent Number: 4,494,435

[45] Date of Patent: Jan. 22, 1985

[54] CUTTING DEVICE

[76] Inventor: Ned Lindsay, P.O. Box 529, Main St., Chester, Vt. 05143

[21] Appl. No.: 535,297

[22] Filed: Sep. 23, 1983

[51] Int. Cl.[3] ..... B26D 3/08

[52] U.S. Cl. ..... 83/880; 83/879; 83/37; 83/315; 83/349; 83/511

[58] Field of Search ..... 83/879–881, 83/509–512, 315, 349, 284, 285, 37

[56] References Cited

U.S. PATENT DOCUMENTS

| | | | |
|---|---|---|---|
| 2,633,194 | 3/1953 | Gammeter | 83/511 |
| 2,957,379 | 10/1960 | Sidebotham, Sr. | 83/512 X |
| 3,823,636 | 7/1974 | Spengler | 83/511 |
| 4,331,055 | 5/1982 | Kammann | 83/510 X |

*Primary Examiner*—James M. Meister
*Attorney, Agent, or Firm*—Martin Leitner

[57] ABSTRACT

There has been provided a cutting device utilizing a fixed cutting edge and a movable roller axially mounted on a radial arm parallel to the cutting edge. The roller has an outer surface which is also parallel to the cutting edge. A composite laminate for making peelable labels is moveably supported between feed and take up rolls in parallel spaced relation with the roller and the cutting edge. The radial arm is actuated for moving the roller against one side of the composite and urging an opposite side thereof against the cutting edge for effecting the cut as the roller moves in proximate spaced relation with the cutting edge. The radial arm and roller carried thereby swings between extreme stop positions, and a cut is made each time the roller swings in proximate spaced relation to the cutting edge. The frequency of the swings of the radial arm, or the speed of the composite past the blade determines the length or distance between the cuts. The spacing of the blade and roller at the closest point is less than the thickness of the composite, thus, when a cut is made, the composite remains intact, but peelable labels are formed thereon, which may rolled up on the take up reel.

9 Claims, 5 Drawing Figures

FIG. 1
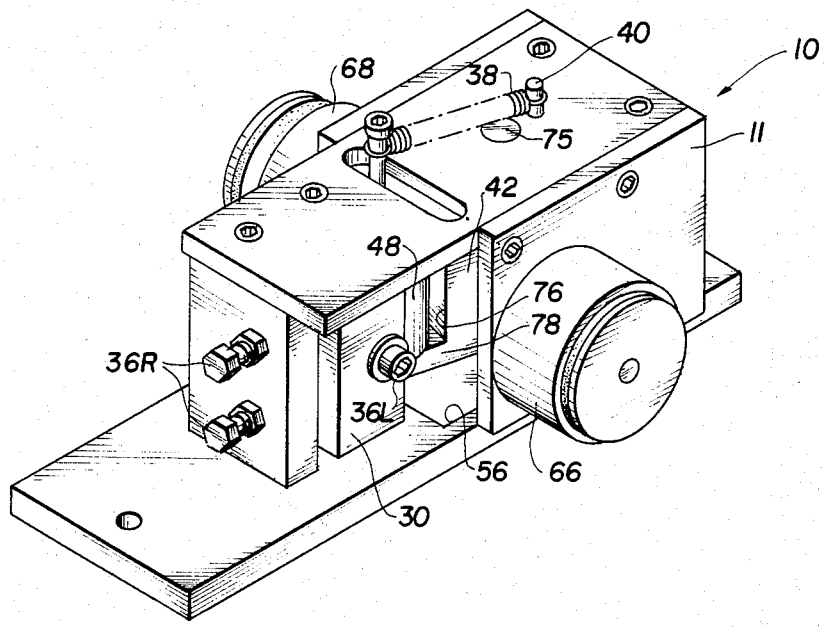
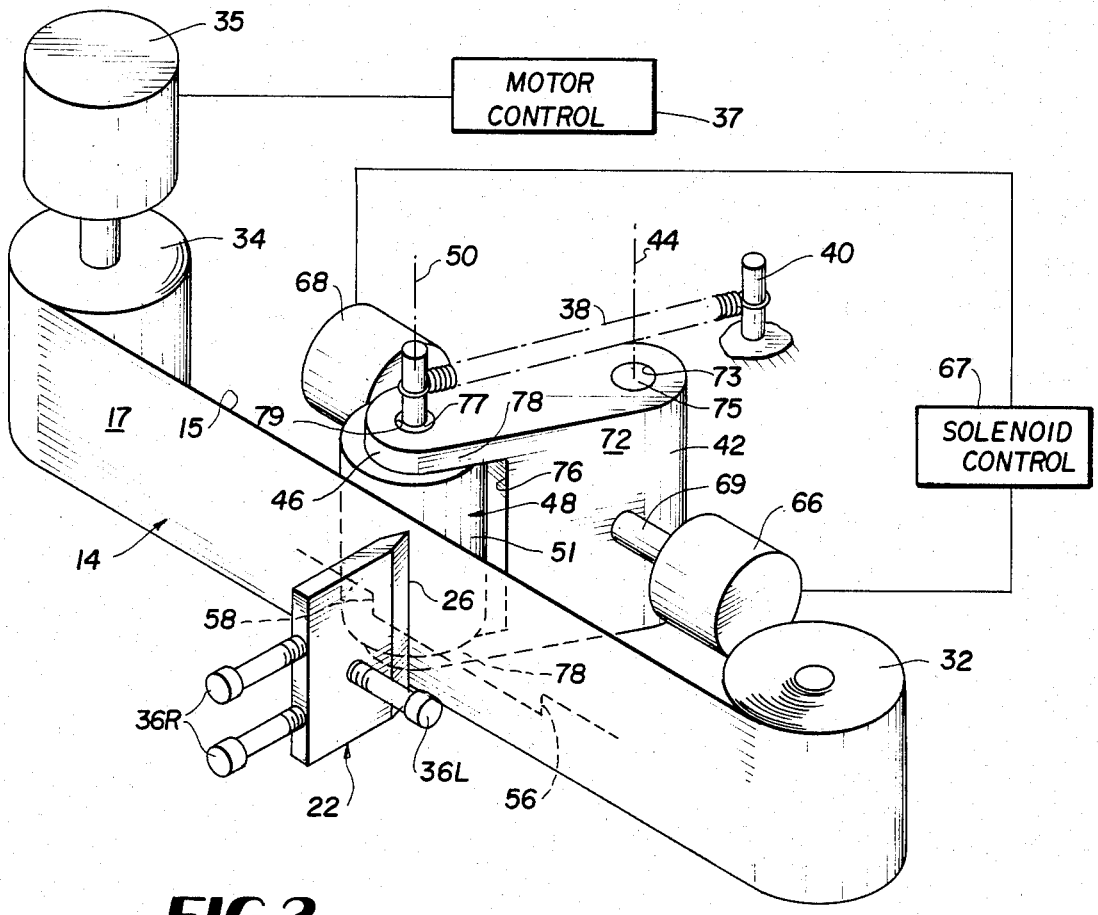
FIG. 2

CUTTING DEVICE

The invention relates to a cutting device for multilayer composite laminate sheet. More particularly, the invention relates to a label cutter for perforating or cutting the margins of an overlayer or label material secured to a substrate or release layer by pressure sensitive adhesive. The cutter perforates the label material and leaves the release layer intact so that the composite may be rolled up for shipping, storage and dispensing. Labels so formed may be individually peeled away from the substrate. The adhesive preferentially sticks to the label material and releases from the release layer.

Cutting devices for labels and the like include moving shear and punch type blades such as shown in U.S. Pat. Nos. 4,153,496; 4,246,058; and 4,273,606. These cutters are expensive to build because accurate machining is required to make the mating parts. Also, the working or cutting parts wear during use, necessitating adjustment, and ultimately, replacement. The cutters referred to above have a fixed size configuration. That is, the cutters only make one label size. If another label size is desired, the cutters must be changed. Thus, an inventory of cutters is necessary to make different size labels. Increased cost thereby results.

The cutting device of the present invention incorporates a moving roller for urging the overlayer of the composite against a stationery cutter. The roller and cutter are spaced so that only the desired one or more overlayers of the composite are cut, leaving the substrate intact.

SUMMARY OF INVENTION

There has been provided a cutting device for cutting one or more overlayers of a moving composite laminate formed of a substrate material and at least one overlayer adhered to the substrate by an adhesive. The cutting device includes a stationery blade having a cutting edge and a roller mounted for rotation on an axis parallel to the cutting edge. A radial arm, pivotally mounted at one end, supports the roller on its axis. The radial arm is free to carry the roller along an arcuate path into and out of selected proximate spaced relation with the cutting edge. The roller and blade are most closely spaced by a distance equal to the thickness of the overlayer or overlayers to be cut. The spacing is adjustable. Means is provided for carrying the composite in a parallel plane between the cutting edge and the roller. Means for actuating the radial arm engages opposed working surfaces of the same for moving the roller back and forth along the arcuate path. As the composite is carried between the cutting edge and the roller, the roller engages the substrate side of the composite and instantaneously forces the overlayer side into butting relation with the cutting edge thereby causing the blade to cut the overlayer.

DESCRIPTION OF THE DRAWINGS

FIG. 1 is a perspective view of the apparatus of the present invention.

FIG. 2 is a schematic, in perspective, showing the operation of the apparatus.

Figure 3A:
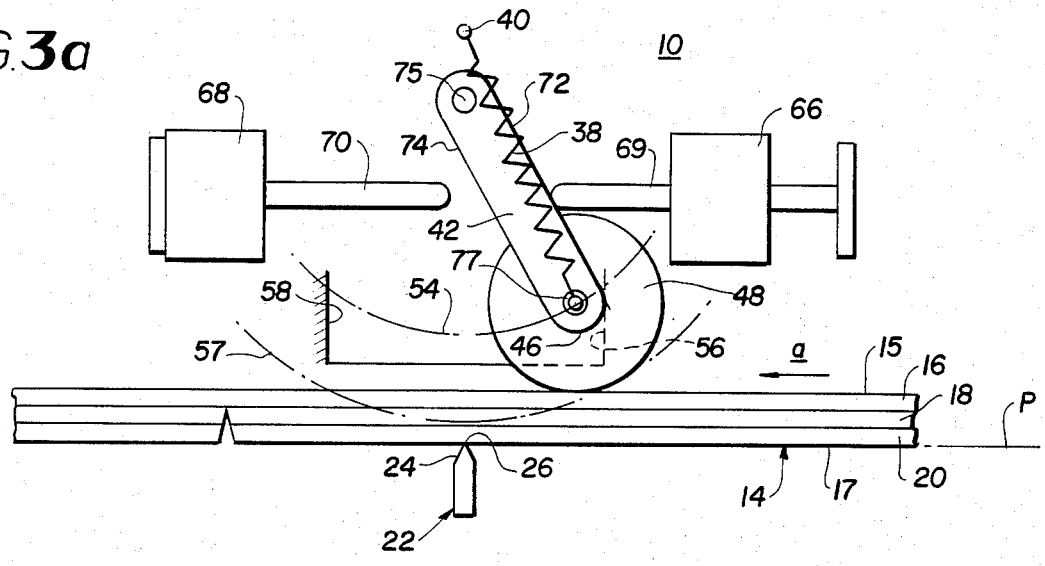

FIGS. *3a*, *3b* and *3c* are schematic plan views of the cutter shown in FIGS. 1 and 2, illustrating the sequence of operation.

DESCRIPTION OF THE PREFERRED EMBODIMENT

Referring to FIGS. 1 and 2, there is shown a cutting device or cutter 10 according to the present invention. The cutter 10 includes a housing 11 to which operating parts of the device are attached as hereinafter described, a stationery blade 22 having a cutting edge 26 and a cylindrical roller 48 mounted for rotation about a central axis 50 parallel to cutting edge 26. An outer cylindrical surface 51 of the roller 48, likewise, is parallel to the cutting edge 26.

A composite laminate 14 having respective front and back sides 15 and 17, is carried between the roller 48 and the cutter 22 by respective feed and take up rolls 32 and 34. The rolls 32 and 34 are driven by a motor 35 governed by speed control 37. The composite 14 is carried between the roller 48 and cutting edge 26 in a plane P parallel with each in the direction shown by arrow a.

A radial arm 42 is mounted in the housing 11 for pivotal motion about a pivot axis 44. Stops 56 and 58, mounted or formed in housing 11, limit the motion of radial arm 42. A free end 46 of the radial arm is free to move along an arcuate path 54. The length of the arcuate path or arc 54 is determined by the position of the opposed stops 56 and 58, which engage opposed working surfaces 72 and 74 of the radial arm 42. The roller 48 is carried at the free end 46 of the radial arm 42. A point 55 on the other surface 51 of the roller 48, in radial alignment with the pivot 44, traces and arc 57 concentric with the arc 54. The roller 46 has an axial bore or aperture (not shown) formed therein.

The radial arm 42 is preferably formed of planar or flat stock having opposed parallel working surfaces 72 and 74 and an aperture 73 for receiving a pivot or mounting pin 75 at pivot axis 44. The free end 46 of the radial arm 42 is formed with a notched portion or notch 76 forming opposed supports 78 having axially aligned apertures 79 therein. The roller 48 is carried between the supports 78 by axial pin 77 sleeved in apertures 79 and passing through the aperture therein.

Actuators 66 and 68, located near respective stops 56 and 58, have respective extendable plungers 69 and 70, which engage the respective working surfaces 72 and 74 of the radial arm 42. When electrically energized, each actuator 66 and 68 causes its respective plunger 69 and 70 to extend for engaging the respective working surface 72 and 74 of the radial arm 42. Normally, actuators 66 and 68 are electrical solenoids sequentially energized by a suitable control 67 governing the frequency and sequencing of energization thereof, whereby the radial arm 42 is accuated to swing back and forth between the stops 56 and 58.

As the radial arm 42 moves it carries the roller along the arc 57 as noted above. The roller surface 51 and cutting edge 26 are most closely spaced when they are in radial alignment as illustrated in FIG. *3b*.

In a preferred embodiment, cutting device 10 is adapted to cut one or more layers of the composite laminate or tape 14. The tape 14 is formed of a substrate or release layer 16, an adhesive layer 18 deposited thereon, and an overlayer or printable layer 20 adhered to the substrate 16 by the adhesive 18. The adhesive has preferential affinity for the overlayer 20 so that when labels are formed, as hereinafter described, the label and adhesive releases from the substrate. The cutting device is adapted to make a cut 62 only through the overlayer 20, leaving the substrate 16 intact.

In FIG. 3*a*, the radial arm 42 and roller 48 are shown at rest at the extreme right hand position against the stop 56. The composite or tape 14 is moving to the left as shown by the arrow a. When the accuator 66 is energized, the plunger 69 engages the working surface 72 of the radial arm 42 whereby it is moved to the left along the arc 54. The point 55 on the outer surface 51 of the roller 48 moves along the concentric arc 57.

Figure 3B:
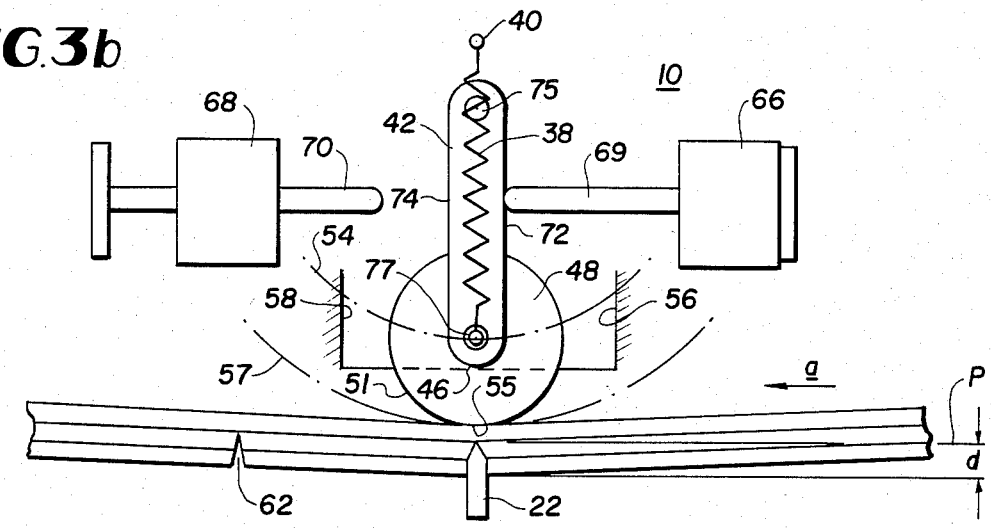

In FIG. 3*b*, the surface 51 of the roller 48 engages the back or substrate side 15 of the composite 14 at point 55 and urges it out of the plane P so that front or label side 17 of the composite 14 engages the cutting edge 26. The outer surface 51 of the roller 48 comes closest the cutting edge 26 when the radial arm 42 is in radial alignment with the cutter 24 as shown in FIG. 3*b*. At this point the cutting edge 26 and the outer surface 51 of the roller 48 are separated by a spacing d. As the roller 48 passes the cutting edge (to the left FIG. 3*b*) the cut 62 is made to a depth equal to spacing d. The overlayer 20 of the composite 14 has a thickness which, in the preferred embodiment, is the same as the spacing d of the cutting edge 26 and the outer surface 51 of the roller 48 at the position shown in FIG. 3B. Thus, only the overlayer 20 is cut in the process.

The cutting action is sharp and quick so that the composite 14 continues to move while the cut 62 is made, with little or no perceptable hesitation or flutter. The sharp cutting action is enhanced by snap action spring 38 secured between pin 40 in housing 11 and the axial pin 77 supporting the roller 48 at the free end of the radial arm 42.

The blade 24 is secured in housing 11 by a holder 30. Radial and lateral adjusting screws 36-R and 36-L, which may be orthogonally arranged, position the holder 30 in the housing 11 with respect to the roller 48. Thus, the depth of the cut may be adjusted by positioning the cutting edge 26 with respect to the roller 48 and by tightening the adjusting screws 36-R and 36-L. Shims may be used to gap the blade 72 and the roller 48.

Figure 3C:
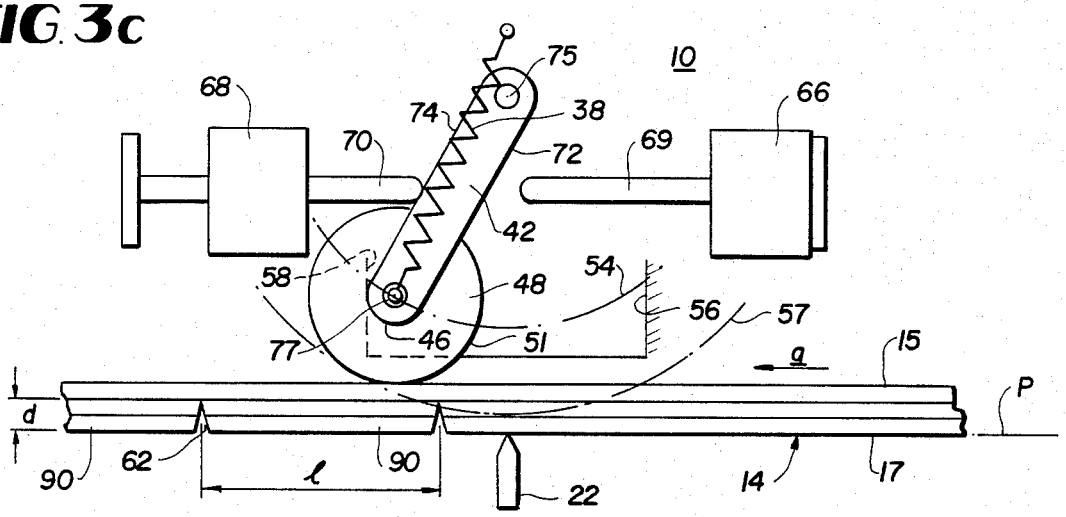

In FIG. 3*c*, radial arm 42 is shown at rest against stop 58 in the extreme left hand position. The composite 14 continues to move to the left as shown. The accuator 68 may then be energized, causing the plunger 70 to engage the working surface 74 of the radial arm 42 to thereby move the same to the right along the arc 54. When the roller 48 moves past the cutting edge 26, another cut 62 is made in the same manner as hereinbefore described except that the roller 48 moves to the right or opposite the direction of the moving composite 14.

The cuts 62 may be spaced by an appropriate length l defining a label 90 (shown in FIG. 3C). The spacing l defines the size of the label 90. By varying either the speed of the motor 35 or the frequency of control 67, the size of the label 90 may be varied in any desired manner. Appropriate speed control 37 for the motor 35 is known. Further, appropriate circuitry for control 67, such as a flip flop, is known. The duration of the time between sequential accuation of accuators 66 and 68 and the speed of motor 35 determines the length l between the cuts 62. If the frequency of operation of the accuators 66 and 68 is constant then the speed of the motor 35 may be varied to change the length l between the cuts 62, and vice versa.

Because the cutting edge 26 is spaced from the roller, as described above, it engages only the composite 14. Thus, wear on the cutting edge 26 of the blade 24 is virtually eliminated. Very little adjustment of the blade 24 is required, and blade inventory is reduced to a minimum.

There has thus been provided an apparatus for cutting a composite laminate in order to form peelable labels and the like. The laminate is urged against the stationery cutting blade by a movable backing member or the like. During the cutting operation, the composite continues to move from a feed roll to a take up roll, but the cutting action is so rapid and sharp that, except for minor flutter in the motion of the composite, it continues to move during the cutting stroke.

What is claimed is:

1. A device for cutting at least one layer of a moving multilayer composite laminate formed of a substrate and an overlayer adhered to the substrate by an adhesive therebetween, the device comprising: a stationery blade having a cutting edge; a roller having a cylindrical surface, the roller mounted for rotation about a central axis parallel to the cutting edge; a radial arm being pivotally mounted at one end and having a free end supporting the roller along its axis, said radial arm for carrying the roller along an arcuate path into and out of proximate spaced relation with the cutting edge; means for movably supporting the composite in a plane parallel with and between the cutting edge and the roller with the overlayer proximate the cutting edge; means for accuating the radial arm to move the roller along the arcuate path as the composite is carried between the cutting edge and the roller, said roller surface engaging the substrate and urging the overlayer against the cutting edge for cutting the same.

2. A device as defined in claim 1 wherein the radial arm comprises a planar member having opposed lateral working surfaces and a notched portion at the free end; a pair of opposed support members extend from the notched portion, said roller being mounted for rotation between said support members.

3. A device as defined in claim 1 wherein the means for actuating the radial arm comprises a pair of electrically energizable solenoids mounted in opposition to each other and the opposed working surfaces of the radial arm, each solenoid for engaging a respective one of said working surfaces for urging the radial arm away therefrom.

4. A device as defined in claim 3 wherein the solenoids are actuated in opposition such that when one is energized the other is de-energized.

5. A device as defined in claim 1 wherein the overlayer is a material of a selected thickness and the adhesive preferentially adheres to the overlayer such that when the cut is made, the overlayer and adhesive may be removed from the substrate.

6. A device as defined in claim 1 further including means for adjustably supporting the blade for spacing the cutting edge of the blade relative to the roller, said means including a pair of orthogonal adjusting screws for urging the support radially and laterally of the roller.

7. A device as defined in claim 1 further including a speed control operatively coupled to the means for moving the composite for varying the speed of said substrate past the cutting edge.

8. A device as defined in claim 1 further including accuator control means operatively coupled to the means for actuating the radial arm for controlling the time the roller moves into proximate spaced engagement with the cutting edge.

9. A method for cutting at least one layer of a multilayered moving composite of selected thickness comprising the steps of: fixing a cutting blade in a stationery position; movably supporting a roller in parallel spaced relationship with the fixed cutting edge; moving the roller along an arcuate path in proximate space relationship with the cutting edge; moveably supporting the composite in parallel spaced relationship between the roller and the cutting edge; engaging the composite from one side with the roller and thereby urging an opposite side of said composite into engagement with the cutting edge, for cutting the same as the roller moves in proximate spaced relation with said cutting edge; and establishing a spacing of the roller and the cutting edge, such that, at the position of proximate spaced relation, the spacing of the roller and cutting edge is less than the thickness of the composite, so that, after the cut is made, the composite remains intact.

* * * * *